United States Patent [19]

Berry et al.

[11] Patent Number: 5,062,642

[45] Date of Patent: Nov. 5, 1991

[54] TRAINING DEVICE

[76] Inventors: Troy R. Berry, 4924 Pershing, Fort Worth, Tex. 76107; Larry R. Mills, 7258 Valleydale Ct., Fort Worth, Tex. 76116

[21] Appl. No.: 581,037

[22] Filed: Sep. 12, 1990

[51] Int. Cl.[5] ..... A63B 69/36; A63B 21/04; A63B 21/02; A63B 21/00

[52] U.S. Cl. ..... 273/183 B; 273/188 A; 272/139; 272/143; 272/142

[58] Field of Search ..... 272/138, 139, 143, 142, 272/135; 273/188 R, 183 B, 188 A

[56] References Cited

U.S. PATENT DOCUMENTS 2,097,376 10/1937 Marshman ..... 272/139
4,955,608 9/1990 Dougherty et al. ..... 273/188 R

*Primary Examiner*—George J. Marlo
*Attorney, Agent, or Firm*—James E. Bradley

[57] ABSTRACT

A training device is worn by a user for strengthening and training the legs. A belt extends around the waist of the user. An elastic strap has two forward runs and two rearward runs. Each of the forward runs secures to the belt at an upward end along the front section of the belt. The forward runs extend down to a loop which receives the user's foot. The rearward runs extend from the loop back to apertures located on the back section of the belt.

4 Claims, 2 Drawing Sheets

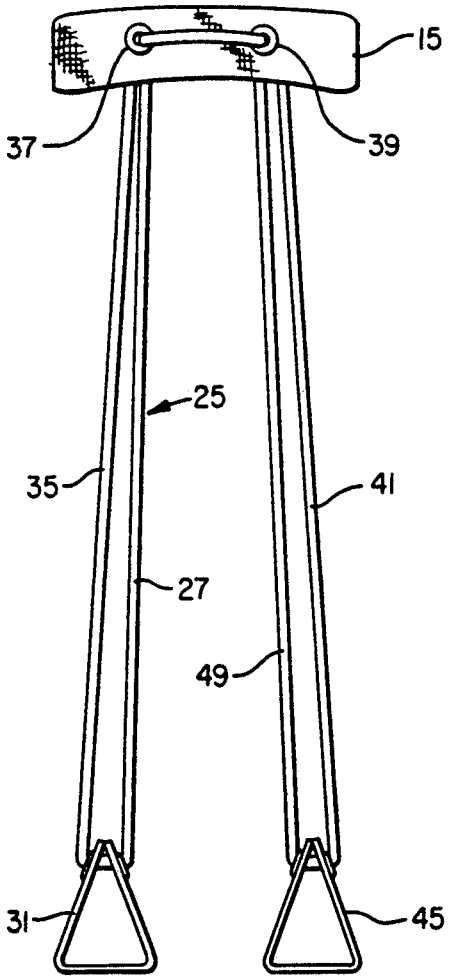
FIG. 2
FIG. 3
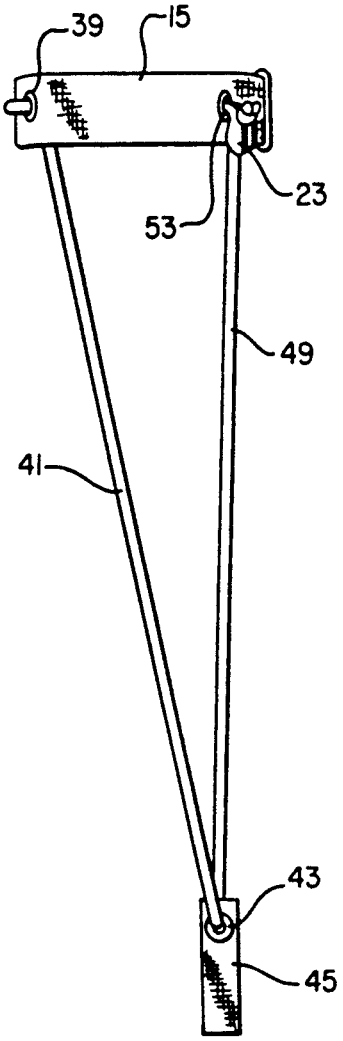

TRAINING DEVICE

BACKGROUND OF THE INVENTION

1. Field of the Invention

This invention relates in general to devices for use in athletic training, and in particular to a device using elastic straps extending alongside the legs for training and conditioning of the legs.

2. Description of the Prior Art

There is a need for a training device for the legs in various sports. In sports such as golf, keeping one's legs in proper position is very important. Also, strengthening and conditioning the legs for many sports is essential.

There are several patents which show straps which extend from the waist of the body to the ground for use in golf training. These devices, however, do not adequately strengthen legs nor provide the proper positioning. Also, they would not be useful for other sports.

SUMMARY OF THE INVENTION

The device of this invention includes a belt which connects around the waist of the user. The belt has a back section which locates on the back of the user and a front section which locates on the front of the user. A single continuous elastic strap having two forward runs and two rearward runs connects to the belt. The forward runs extend from spaced apart points on the front section of the belt down to loops which receive the user's feet. The rearward runs extend from spaced apart points on the back section of the belt down to the loops.

BRIEF DESCRIPTION OF THE DRAWINGS

FIG. 2 is a rear view of the training device of FIG. 1.

FIG. 3 is a side view of the training device of FIG. 1.

DESCRIPTION OF THE INVENTION

Figure 1:
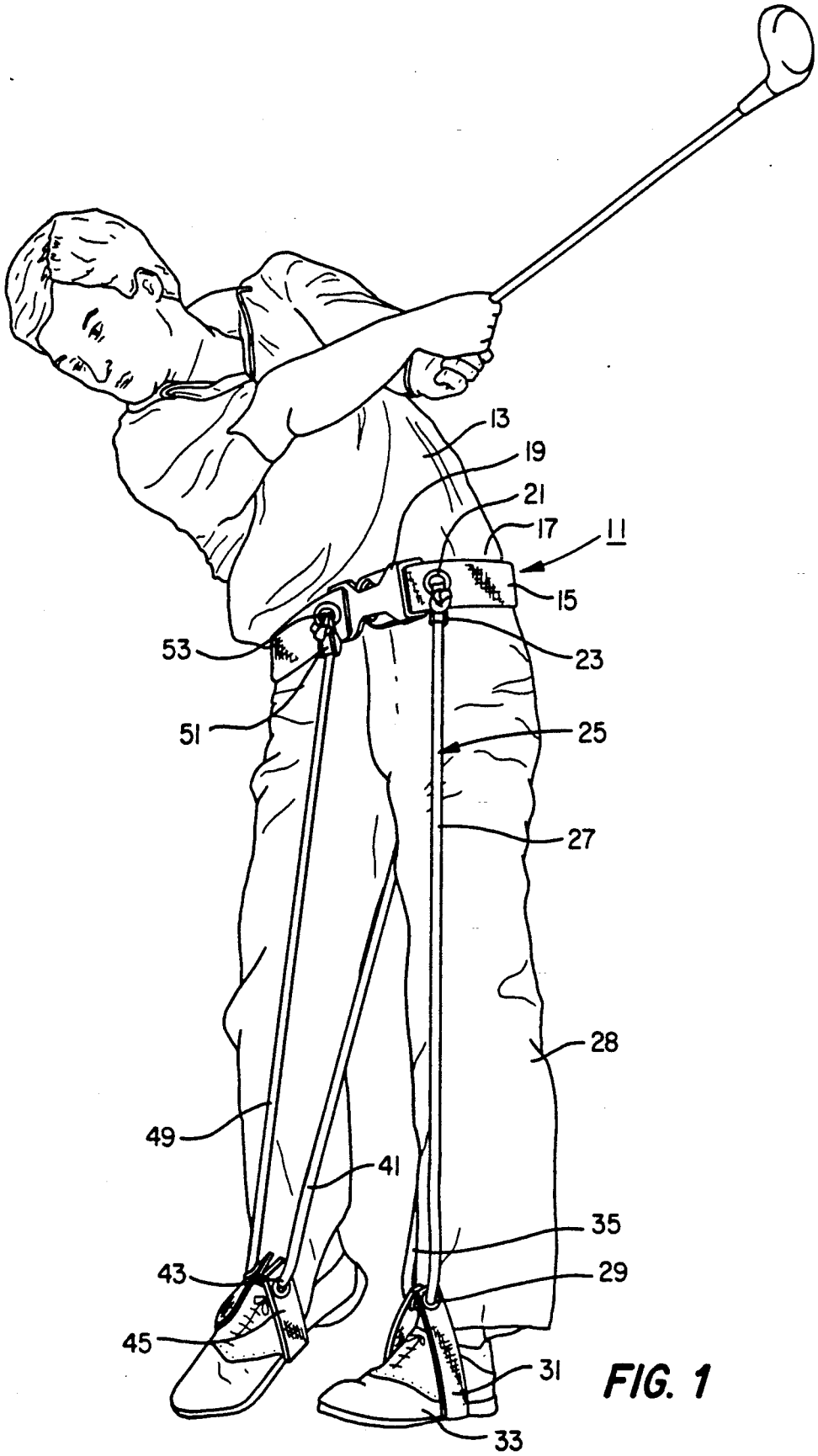
FIG. 1 is a perspective view illustrating a training device constructed in accordance with this invention, shown worn by a user.

Referring to FIG. 1, the training device 11 is shown being worn by a user 13. The training device 11 includes a belt 15. Belt 15 couples about the waist 17 of user 13 and is secured by a conventional fastener 19. Belt 15 preferably is a wide belt of woven fabric.

An aperture 21 extends through the belt 15 in the front section next to one side of fastener 19. A clip 23 will releasably clip into the aperture 21. An elastic cord or strap 25 connects to the end of the clip 23. Clip 23 is of a type that will allow the strap 25 to be selectively tensioned by pulling on the end of the strap 25.

The strap 25 extends downward from clip 23, defining a forward run 27. The forward run 27 locates in front of one leg 28 of user 13. The lower end of the forward run 27 extends through a pair of apertures 29 in a loop 31. Loop 31 is a strap of fabric formed into the shape of a loop for receiving one shoe 33 of user 13.

The elastic strap 25 extends through the apertures 29 in loop 31, and defines the lower end of a rearward run 35, also shown in FIG. 2. Rearward run 35 extends upward along the inside of the user's leg 28. Rearward run 35 extends upward to an aperture 37 formed in the back section of the belt 15. The upper end of rearward run 35 extends through the aperture 37 then over, parallel with belt 15, to another aperture 39. Aperture 39 is also in the back section of belt 15, and is spaced a considerable distance from aperture 37.

The strap 25 extends through aperture 39 then downward in a rearward run 41. Rearward run 41 extends along the inside of the other leg 28 of the user 13 into an aperture 43 of a loop 45. Loop 45 is identical to loop 31. The strap 25 extends through the apertures 43, then back up in a forward run 49. The forward run 49 extends along the front of the user's leg 28. The upper end of the forward run 49 terminates in a clip 51 which is identical to clip 23. Clip 51 releasably clips to an aperture 53.

To put the training device 11 on, the user 13 will place the belt 15 about his waist and connect the fastener 19. He places his shoes 33 through the loops 31 and 45. He will clip the clips 23 and 51 to the apertures 21 and 53. He will tension the strap 25 to a selected amount by pulling on the upper ends of the forward runs 27, 49.

The user can use the device for driving golf balls while practicing, as illustrated in FIG. 1. It helps him to emphasize the legs. It helps the user feel his feet and feel the base position as he swings in his turns. It allows the user to make freer turns. It enables the user to sense where his legs should be. The user can practice other sports such as baseball, softball, and tennis. The user is free to walk with the device or for jogging training to strengthen the legs. A stroke victim could use the device to assist him in picking up his legs for therapy.

While the invention has been shown in only one of its forms, it should be apparent to those skilled in the art that it is not so limited, but is susceptible to various changes without departing from the scope of the invention.

We claim:

1. A training device adapted to be worn by a user, comprising in combination:

a belt adapted to be connected around a waist of a user, with a back section extending around the back of the user and having a front section located on the front of the user;

fastening means on the front section of the belt for fastening the belt around the user;

an elastic strap having two forward runs and two rearward runs, each of the forward runs having an upper end joining the front section of the belt and extending downward to a lower end, and each of the rearward runs having an upper end joining the back section of the belt and extending downward to a lower end;

loop means for retaining the lower ends of one of the forward runs and one of the rearward runs with one foot of the user and for retaining the other of the forward runs and rearward runs with the other foot of the user; and wherein the loop means comprises a flexible loop which is adapted to receive the user's foot, with the forward and rearward runs sized to be in tension, and with the loops pulling upward on an arch of the user's foot when the user's legs are straightened.

2. The device according to claim 1 wherein each of the loops comprises a strap of fabric.

3. The device according to claim 1 wherein the upper ends of the forward runs are spaced apart from each other and the upper ends of the rearward runs are spaced apart from each other.

4. A training device adapted to be worn by a user, comprising in combination:

a belt adapted to be connected around the waist of a user, with a back section adapted to extend around the back of the user and having a front section adapted to locate on the front of the user;

fastening means on the front section of the belt for fastening the belt around the user;

an elastic strap having two forward runs and two rearward runs, each of the forward runs having an upper end joining the front section of the belt on opposite sides of the fastening means and extending downward to a lower end, and each of the rearward runs having an upper end joining the back section of the belt at spaced apart locations and extending downward to a lower end;

a pair of flexible loops, each loop adapted to receive a foot of the user, the lower ends of one of the forward runs and one of the rearward runs joining one of the loops and the lower ends of the other of the forward runs and the rearward runs joining the other of the loops, with each of the rearward runs extending on the inside of each leg of the user;

the straps being sized to be in tension when the user inserts a foot into each loop and the user's legs are straightened, pulling upward on the arch of each of the user's feet; and the belt being free of any members secured thereto and extending upward therefrom for positioning on a user's shoulders, so that all of the downward force imposed on the belt through the tensioned straps is supported entirely by the belt and waist of the user, freeing the user's shoulders of any downward forces imposed by the straps.

* * * * *